US005957570A

United States Patent [19]

Ooyama et al.

[11] Patent Number: 5,957,570

[45] Date of Patent: Sep. 28, 1999

[54] REFLECTOR DISCHARGE LAMP

[75] Inventors: Masachika Ooyama; Yoshio Okazaki, both of Himeji, Japan

[73] Assignee: Ushiodenki Kabushiki Kaisha, Tokyo, Japan

[21] Appl. No.: 09/050,934

[22] Filed: Mar. 31, 1998

[30] Foreign Application Priority Data

Apr. 17, 1997 [JP] Japan ..... 9-114200

[51] Int. Cl.[6] ..... H01J 5/20

[52] U.S. Cl. ..... 362/263; 362/264; 362/267; 362/310; 313/113

[58] Field of Search ..... 362/263, 307, 362/264, 294, 373, 267, 310; 313/113, 626, 331

[56] References Cited

U.S. PATENT DOCUMENTS 5,506,464 4/1996 Ooms .

FOREIGN PATENT DOCUMENTS 5-251054 9/1993 Japan .

*Primary Examiner*—Thomas M. Sember

*Attorney, Agent, or Firm*—Sixbey, Friedman, Leedom & Ferguson; David S. Safran

[57] ABSTRACT

A reflector discharge lamp in which a concave reflector has a front cover and in which a foil seal arrangement of hermetically sealed portions of a discharge lamp mounted therein can be advantageously prevented from reaching a high temperature. This is achieved by the discharge lamp being arranged such that a longitudinal axis of the discharge lamp coincides with the optical axis of the concave reflector by the end area of one of the hermetically sealed portions of the discharge lamp being located in an area of the concave reflector which is opposite the front cover. The end area of the other hermetically sealed portion projecting at least partially through and beyond an aperture in the front cover.

6 Claims, 3 Drawing Sheets

REFLECTOR DISCHARGE LAMP

BACKGROUND OF THE INVENTION

1. Field of the Invention

The invention relates to a reflector discharge lamp in which a discharge lamp is combined with a concave reflector. The invention relates especially to a reflector discharge lamp in which a mercury lamp of the short arc type or metal halide lamp likewise of the short arc type is used as the discharge lamp, and which is used for a liquid crystal projector or the like.

2. Description of the Related Art

Recently liquid crystal projectors have been drawing attention. As their light source device, a reflector discharge lamp is used in which a discharge lamp of the short arc type is installed in a concave reflector.

There is a need to reduce the size of metal halide lamps which are used for liquid crystal projectors and the like. Therefore, a small lamp with a total lamp length of 65 mm is used. This lamp is installed in a reflector and is used to increase light efficiency.

Furthermore, recently there has generally been a front cover on the front side of the reflector to prevent, in the unwanted case of breakage of the lamp during operation, the high temperature fragments formed thereby from being flung into the surroundings.

This technology is disclosed, for example, in Japanese patent disclosure document HEI 5-251054 and Japanese patent disclosure document HEI 6-203806.

In a reflector discharge lamp in which the front of the reflector is covered with a front cover, however, the space in the reflector is essentially in a sealed state. Therefore, during operation, the lamp reaches an extremely high temperature. With regard to the fact that, in the emission space emission metals which fill it should vaporize well, it can also be imagined that a certain temperature increase is desirable. However, in the hermetically sealed portions with a foil seal arrangement, such defects as breaking of the foil and the like occur due to oxidation that results due to high temperature.

SUMMARY OF THE INVENTION

Therefore, a primary object of the invention is to devise a reflector discharge lamp in which the reflector has a front cover and in which the hermetically sealed portions with a foil seal arrangement can be advantageously prevented from reaching a high temperature.

In a reflector discharge lamp in which, in a discharge space of a discharge lamp, there is a pair of electrodes and which has, on both sides, hermetically sealed terminations and a concave reflector which is made integral with this discharge lamp, and in the front opening, has a front cover, and which is arranged such that the axis of the discharge lamp and the optical axis of the concave reflector essentially agree with one another, this object is achieved in accordance with the invention by the end area of one of the hermetically sealed portions of the discharge lamp being located in an area of that end of the concave reflector opposite the front cover, and by the end area of the other hermetically sealed portion projecting at least partially beyond an aperture located in the front cover.

The object of the invention is furthermore advantageously achieved by there being a distance of no more than 1.1 mm between the aperture of the front cover and the outer surface of the hermetically sealed portion of the discharge lamp.

The object of the invention is furthermore advantageously achieved by a metal foil being inserted in the end area of one hermetically sealed portion and being joined to an outer lead, and the end area projecting beyond the front cover so far that at least one part of the end area provided with the metal foil projects beyond the front cover.

The object of the invention is moreover advantageously achieved by a line which emerges from the end of the hermetically sealed portion which projects beyond the aperture of the front cover being attached in one area of the concave reflector.

The object of the invention is furthermore advantageously achieved by the discharge lamp being a discharge lamp of the short arc type in which inert gas and mercury or inert gas, mercury and at least one metal halide are added as the fillers.

By means of the above described arrangement, the hermetically sealed portion which projects beyond the opening of the front cover comes partially into contact with the outside air. Therefore, natural air cooling or forced air cooling can be advantageously achieved without being influenced by a high temperature being reached within the reflector.

In the following the invention is further described using several embodiments shown in the drawings.

DETAILED DESCRIPTION OF THE PREFERRED EMBODIMENTS

Figure 1:
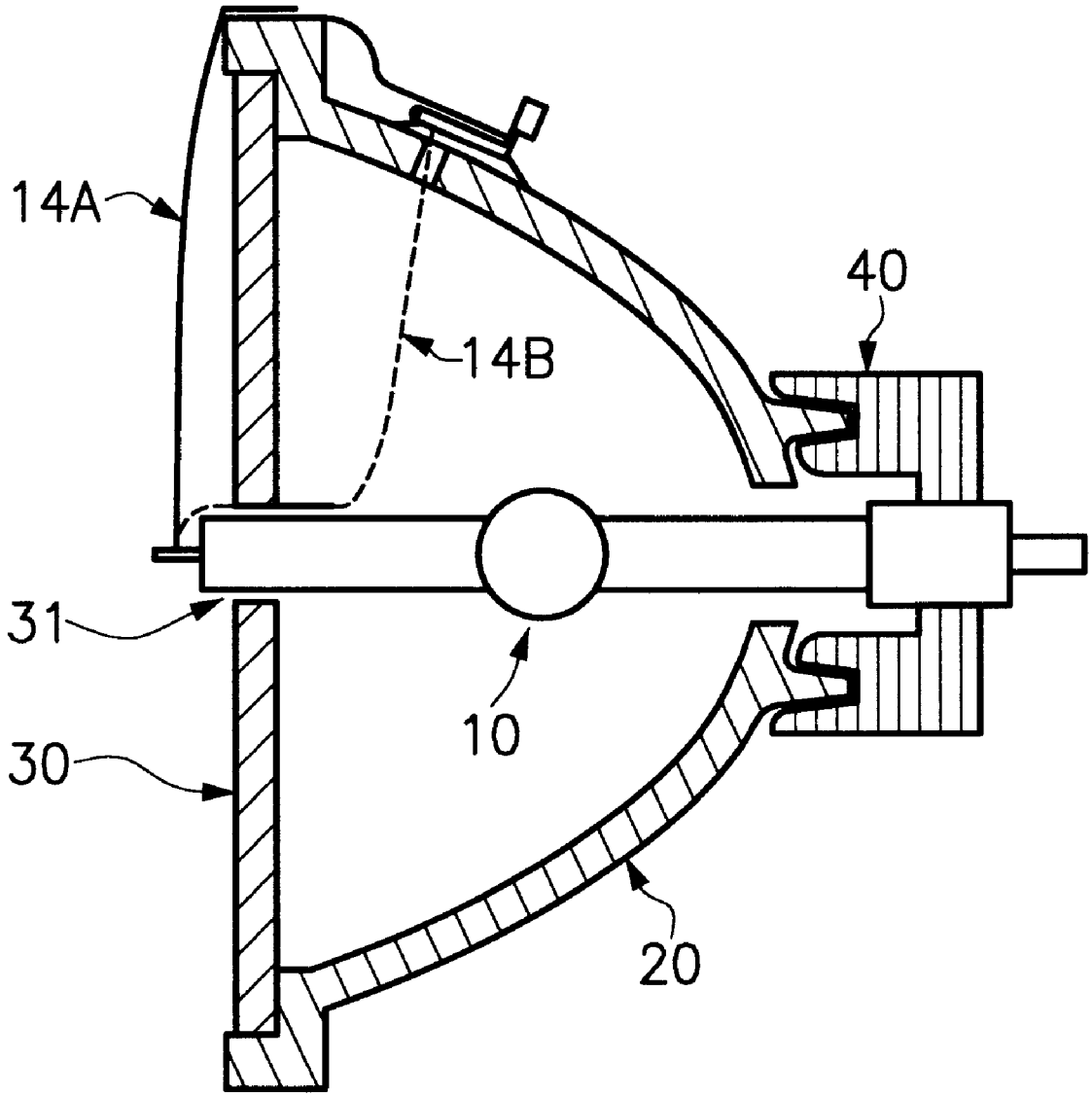
FIG. 1 is a schematic cross-sectional view of a reflector discharge lamp in accordance with the invention.

In FIG. 1, one embodiment of the reflector discharge lamp of the invention is shown in which a discharge lamp 10 is installed in a concave reflector 20. In a front aperture of concave reflector 20, is a front cover 30. One of the hermetically sealed portions of discharge lamp 10 projects beyond the end of concave reflector 20 and is supported by a supporting component 40 or the like which forms a socket with the outer surface of concave reflector 20.

Discharge lamp 10 is a mercury lamp of the short arc type or a metal halide lamp of the short arc type in which, on the two ends of an arc tube of quartz glass, hermetically sealed portions are formed into which a metal foil of molybdenum or the like is inserted, to which one outer lead and the upholding part of the electrode are welded. Within the arc tube, mercury or mercury and at least one metal halide are added as the emission metals. Furthermore, rare gas, such as argon and the like, is also added. As the metal halides, for example, dysprosium iodide, cesium iodide and the like are added. For example, the distance between the electrodes is 1.0 mm, the inner volume of the arc tube is 0.4 cc and the rated power is 150 W.

In concave reflector 20, the body is provided with a surface that is a paraboloid of rotation of the second degree, and is made of metal or glass with a reflection surface, such as a dielectric, multiple-layer film or the like. The center axis of reflector 20 coincides with the longitudinal axis of discharge lamp 10. The radiance spot of lamp 10 is in the focal point of the reflector 20. The front of reflector 20, for example, has an inside diameter of 70 mm.

Front cover 30 consists for example of reinforced glass or the like. Its center area is provided with an aperture with an inside diameter which is to a small degree larger than the hermetically sealed portion of discharge lamp 10. This front cover 30 is joined to reflector 20 by means of an adhesive or the like. Furthermore the surface of the front cover can undergo nonreflective coating.

Front cover 30 is designed to prevent high temperature glass fragments from being flung to the outside in the unwanted case of breakage of the discharge lamp 10 during operation. It is furthermore designed to reduce the noise of breakage and the effect of outside air so that a constant lamp temperature is reached.

Supporting component 40 is made, for example, of ceramic and is connected to a projection or the like which is located on the outer surface of reflector 20. The lamp is joined to the neck which is formed integrally with this supporting part or reflector 20.

Figure 2:
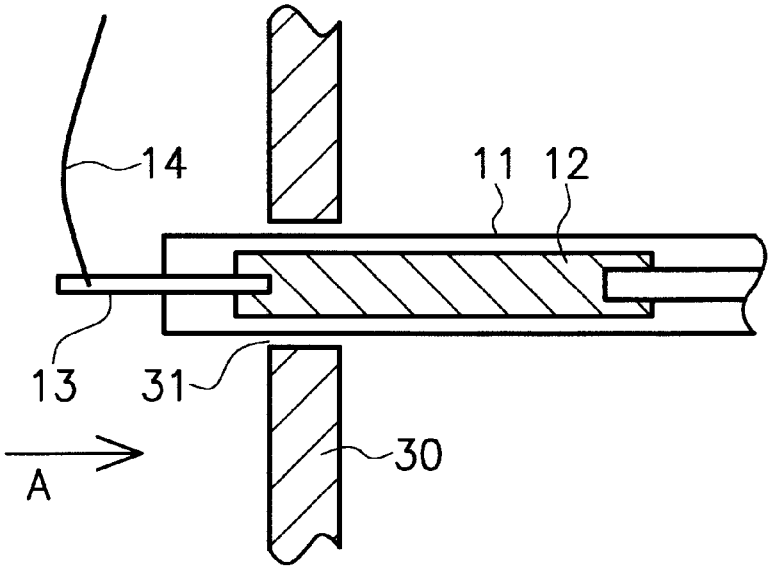
FIG. 2 is an enlarged view of a portion of the FIG. 1 lamp showing the hermetically sealed portion of the discharge lamp projecting beyond the front cover.
Figure 3:
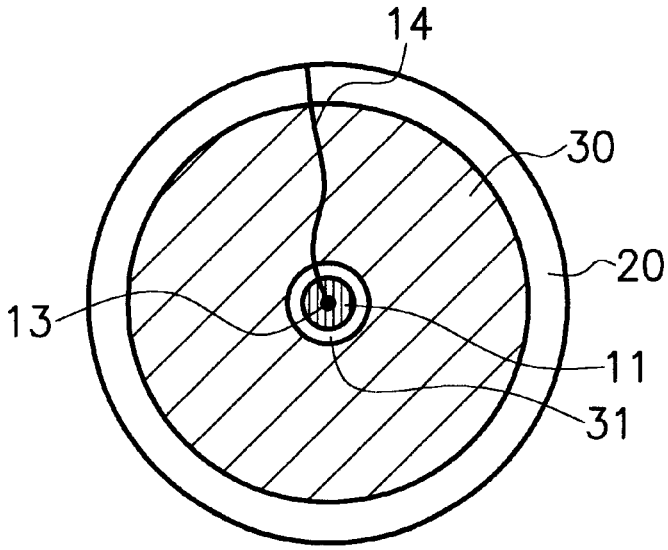
FIG. 3 is a front view showing the relation between the front cover and the hermetically sealed portion of the discharge lamp.

FIGS. 2 and 3 each schematically show that the end of the hermetically sealed portion 11 of discharge lamp 10 projects beyond aperture 31 of the front cover 30. Hermetically sealed portion 11 has a clearance distance of about 0.5 mm relative to the edge surface defining the perimeter of aperture 31. It is preferable that this distance be, at most, less than or equal to 1.1 mm. The reason for this is that, in the case of a distance of greater than or equal to 1.1 mm, the defect arises that the noise produced on breaking of the lamp is at least equal to 70 dB.

The length that hermetically sealed portion 11 projects outwardly from front cover 30 is not specially limited. It is, however, preferred that this projection at least reach the area which is provided with molybdenum foil 12 in order to cool it advantageously. However, sufficient cooling action enabling the end area of hermetically sealed portion 11 or the outer lead 13 to be cooled can be achieved even if the molybdenum foil 12 is not necessarily allowed to project.

The cooling process is not specially limited. Besides natural air cooling, forced air cooling by means of a cooling fan and the like can also be used.

A line 14 is connected to outer lead 13. This line 14 can project from the outside of front cover 30 and can be attached in one part of reflector 20 as is shown in FIG. 1 for portion 14A. Line 14, furthermore, can pass through aperture 31 of front cover 30 and can be attached on the inside of reflector 20 as is shown in FIG. 1 for the portion 14B.

FIG. 3 shows the outer side of the front cover 30, i.e, is a view in the direction of arrow A in FIG. 2. Here, line 14 is located in a part of reflector 20 as was described above, or in a mounting part or the like which is installed in reflector 20. Therefore, unwanted flinging of the area which projects beyond the front cover 30 can be prevented even if in the unwanted case discharge lamp 10 breaks. That is, line 14 acts as a tether.

Figure 4A:
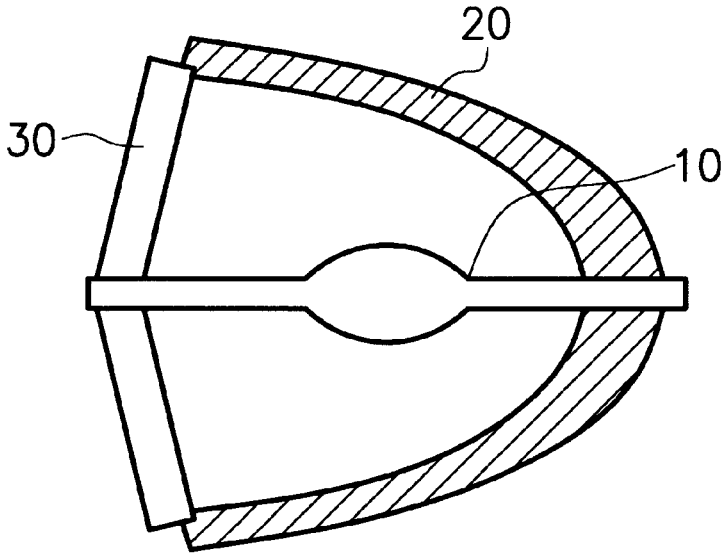
FIGS. 4 (*a*) and (*b*) each show a schematic of another embodiment of the invention.
Figure 4B:
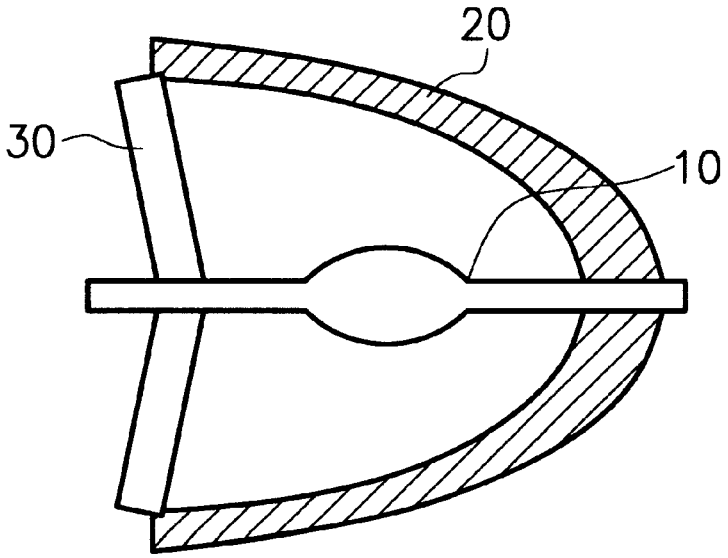

FIGS. 4 (*a*) & (*b*) each show schematically another embodiment of the invention. As shown in these figures, the axial direction of the discharge lamp 10 and front cover 30 need not be in a perpendicular positional relationship relative to each other.

In the following, an experiment is described which shows the action of the invention.

In the experiment, two reflector discharge lamps were used. One of these lamps was a reflector discharge lamp in accordance with the invention, in which the front glass was provided with an aperture and part of the hermetically sealed portions of the discharge lamp projected through and beyond this aperture. For comparison purposes, a reflector discharge lamp was used in which the front glass was not provided with an aperture. In both lamps, a parabolic mirror with a front aperture having an diameter of 78 mm and a F value of 10 was used. The discharge lamps had a lamp input power of 150 W.

The area of the reflector discharge lamp of the invention in which the metal foil and outer lead are welded to one another had a temperature of about 302° C. in the stable operating state of the lamp. The temperature of this area in the comparison reflector discharge lamp, on the other hand, was roughly 413° C. The defect of foil breakage and the like due to oxidation of the metal foil occurred in the case of a temperature of 302° C. after roughly 6000 hours and in the case of a temperature of 413° C. after roughly 1000 hours. This shows that the service life of the reflector discharge lamp in accordance with the invention is six times that of the conventional lamp.

Discharge lamp 10 of the invention is not limited to a metal halide lamp. It goes without saying that the invention can also be used for other discharge lamps, e.g., a xenon lamp, a mercury lamp and the like. Furthermore, it can also be advantageously used for a super high pressure mercury lamp in which the mercury vapor pressure during operation is at least 85 atm.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such chances and modifications as are encompassed by the scope of the appended claims.

What we claim is:

1. Reflector discharge lamp comprising a discharge lamp having a discharge space in which a pair of electrodes are disposed and which has hermetically sealed portions on opposite ends, a concave reflector with a front opening and within which the discharge lamp is mounted with a longitudinal axis of the discharge lamp coincident with an optical axis of the concave reflector, and a front cover in the front opening of the reflector;

wherein an end area of a first one of the hermetically sealed portions of the discharge lamp is located in an area of an end of the concave reflector which is opposite the front cover; wherein an aperture is provided in the front cover; and wherein an end area of a second of said hermetically sealed portions projects through and at least partially beyond said aperture in the front cover.

2. Reflector discharge lamp as claimed in claim 1, wherein a clearance distance that is less than or equal to 1.1 mm exists between an edge of the aperture of the front cover and an outer surface of the hermetically sealed portion of the discharge lamp within the aperture.

3. Reflector discharge lamp as claimed in claim 1, wherein a metal foil is located in the end area of the second hermetically sealed portion and it is joined to an outer lead, and wherein the end area of the second hermetically sealed portion projects beyond the front cover so far that at least part of the metal foil extends beyond the front cover.

4. Reflector discharge lamp as claimed in claim 1, wherein a line emerges from the end area of the second hermetically sealed portion and extends to an area of attachment thereof to the concave reflector.

5. Reflector discharge lamp as claimed in claim 1, wherein the discharge lamp is filled with at least inert gas and mercury as the fillers.

6. Reflector discharge lamp as claimed in claim 1, wherein the discharge lamp is a metal halide lamp filled with inert gas, mercury and at least one metal halide as fillers.

* * * * *